US005806272A

United States Patent [19]

Lafond

[11] Patent Number: 5,806,272

[45] Date of Patent: Sep. 15, 1998

[54] FOAM CORE SPACER ASSEMBLY

[76] Inventor: Luc Lafond, 23 Woodvalley Drive, Etobicoke, Ontario, Canada, M9A 4H4

[21] Appl. No.: 656,684

[22] Filed: May 31, 1996

[51] Int. Cl.[6] ..... E04C 2/54

[52] U.S. Cl. ..... 52/786.13; 52/172; 52/786.11; 156/109; 428/34; 428/192

[58] Field of Search ..... 52/172, 786.11, 52/786.13; 156/105, 107, 109; 428/34, 192

[56] References Cited

U.S. PATENT DOCUMENTS

| | | | |
|---|---|---|---|
| 3,427,776 | 2/1969 | Lake et al. . | |
| 4,120,999 | 10/1978 | Chenel et al. . | |
| 4,149,348 | 4/1979 | Pyzewski | 52/783.13 X |
| 4,205,104 | 5/1980 | Chenel . | |
| 4,622,249 | 11/1986 | Bowser . | |
| 4,649,685 | 3/1987 | Wolf et al. . | |
| 4,822,649 | 4/1989 | Canaud et al. . | |
| 4,831,799 | 5/1989 | Glover et al. . | |
| 4,950,344 | 8/1990 | Glover et al. . | |
| 5,209,034 | 5/1993 | Box et al. | 52/786.13 X |
| 5,260,112 | 11/1993 | Grether et al. . | |
| 5,270,091 | 12/1993 | Krysiak et al. . | |
| 5,308,662 | 5/1994 | Woodard et al. | 52/786.11 X |
| 5,391,411 | 2/1995 | Rowland et al. | 52/786.13 X |
| 5,436,040 | 7/1995 | Lafond | 428/34 |
| 5,441,779 | 8/1995 | Lafond | 428/34 |
| 5,447,761 | 9/1995 | Lafond | 428/34 |
| 5,461,840 | 10/1995 | Taylor | 52/786.13 |
| 5,466,534 | 11/1995 | Newby | 428/34 X |
| 5,503,884 | 4/1996 | Meyer | 52/172 X |

*Primary Examiner*—Beth Aubrey
*Attorney, Agent, or Firm*—Ian Fincham

[57] ABSTRACT

There is disclosed a soft and compliant spacer body wherein the body is provided with modified substrate engaging surfaces to accommodate transverse dimensional changes when the spacer is bent about a corner or otherwise flexed in an insulated assembly. In one embodiment, the corners are cut to reduce the thickness of the strip as the same is bent or flexed about a corner. Other embodiments are disclosed. The advantage is that when the transverse dimension is maintained relatively constant about the bent corner, the result is a more effective seal between the substrate engaging surfaces and the substrates. This is augmented by the use of cellular materials and selected sealants to provide multiple sealing surfaces in a high efficiency spacer body.

30 Claims, 6 Drawing Sheets

10
14

FOAM CORE SPACER ASSEMBLY

FIELD OF THE INVENTION

This invention relates to a foam core spacer for use in insulated substrate assemblies and further relates to insulated glass assemblies incorporating such a spacer.

BACKGROUND OF THE INVENTION

Insulated assemblies presently known in the art incorporate the use of various polymeric substances in combination with other materials. One such assembly includes a butylated polymer in which there is embedded an undulating metal spacer. Although useful, this type of sealant strip is limited in that the metal spacer, over time, becomes exposed to the substrates which results in a drastic depreciation in the efficiency of the strip. The particular difficulty arises with moisture vapour transmission when the spacer becomes exposed and contacts the substrates.

Further, many of the butylated polymers currently used in insulated glass assemblies are impregnated with a desiccant. This results in a further problem, namely decreased adhesiveness of the butylated sealant.

Glover et al. in U.S. Pat. No. 4,950,344, provide a spacer assembly including a foam body separated by a vapour barrier and further including a sealant means about the periphery of the assembly. Although this arrangement is particularly efficient from an energy point of view, one of the key limitations is that the assembly must be fabricated in a number of steps. Generally speaking, the sealant must be gunned about the periphery in a subsequent step to the initial placement of the spacer. This has ramifications during the manufacturing phase and is directly related to increased production costs and, therefore, increased costs in the assembly itself.

One of the primary weaknesses in existing spacer bodies and spacer assemblies relates to the transmission of energy through the spacer. Typically, in existing arrangements the path of heat energy flow through the spacer is simplified as opposed to torturous and in the case of the former, the result is easy transmission of energy from one substrate to the other via the spacer. In the prior art, this difficulty is compounded by the fact that materials are employed which have a strong propensity to conduct thermal energy.

It has been found particularly advantageous to incorporate high thermal performance materials. In one embodiment, a major component of the spacer may comprise a soft or reasonably soft, resilient insulated body, of a material having low thermal conductivity. Such materials may be cellular and examples of materials found to be useful include natural and synthetic elastomers (rubber), cork, EPDM, silicones, polyurethanes and foamed polysilicones, urethanes and other suitable foamed materials. Significant benefits arise from the choice of these materials since not only are they excellent insulators from an energy point of view but additionally, depending on the materials used, the entire spacer can maintain a certain degree of resiliency. This is important where windows, for example, engaged with such a strip experience fluctuating pressure forces as well as a thermal contraction and expansion. By making use of a resilient body, these stresses are alleviated and accordingly, the stress is not transferred to the substrates as would be the case, for example, in assemblies incorporating rigid spacers.

Where the insulating body is composed of a foam material, the foam body may be manufactured from thermoplastic or thermosetting plastics. Suitable examples of the thermosets include silicone and polyurethane. In terms of the thermoplastics, examples include silicone foam or elastomers, one example of the latter being, SANTOPRENE™. Advantages ascribable to the aforementioned compounds include, in addition to what has been included above, high durability, minimal outgassing, low compression, high resiliency and temperature stability, inter alia.

Of particular use are the silicone and the polyurethane foams. These types of materials offer high strength and provide significant structural integrity to the assembly. The foam material is particularly convenient for use in insulating glazing or glass assemblies since a high volume of air can be incorporated into the material without sacrificing any structural integrity of the body. This is convenient since air is known to be a good insulator and when the use of foam is combined with a material having a low thermal conductivity together with the additional features of the spacer to be set forth hereinafter, a highly efficient composite spacer results. In addition, foam is not susceptible to contraction or expansion in situations where temperature fluctuations occur. This clearly is beneficial for maintaining a long-term uncompromised seal in an insulated substrate assembly. The insulating body may be selected from a host of suitable materials as set forth herein and in addition, it will be understood that suitable materials having naturally occurring interstices or materials synthetically created having the interstices would provide utility.

One of the operating difficulties associated with the employment of foams and other cellular material is directed to the fact that the transverse dimension of the spacer body increases when the body is bent or flexed to a corner in an insulated assembly. Typically, the body bulges outwardly exteriorly of the interior atmosphere of the assembly, while the interior is compressed and the substrate engaging surfaces bulge transversely to increase the overall transverse dimension of the body. This reduces the uniformity in the transverse dimension at a flex point and therefore "compresses" or "squeezes" sealant material at the substrate engaging surface to the different thicknesses across the substrate engaging surface. This is of concern with respect to stress on substrates and the efficiency of the seal.

It would be desirable to have a composite spacer which overcomes the limitations of the previously employed materials and the prior art and the energy limitations associated therewith. The present invention is directed to satisfying the limitations.

SUMMARY OF THE INVENTION

One object of the present invention is to provide an improved composite spacer for use in insulated substrate or glass assemblies.

A further object of the present invention is to provide a spacer for spacing substrates in an insulated assembly, comprising:

a flexible cellular body having a transverse dimension, the body including a front face and a rear face in spaced relation, a first substrate engaging surface and a second substrate engaging surface in spaced relation with the first substrate engaging surface; and at least one of the front face and the rear face having a portion of material removed from each corner of a respective face for substantially reducing an increase in the transverse dimension of the body when the body is flexed.

It has been found that at least a portion of material is removed generally adjacent or proximate the substrate engaging surfaces, that a significant advantage can be realized in that the transverse dimension of the body does not increase. Any number of possibilities facilitate this advantage and include, a recess within the engaging surface e.g. arrowhead or pointed recess, a half moon, a zig zag formation among a host of others which will be discussed hereinafter. The result of such cross-sectional profiling is to avoid the "buckling" of the body during bending about the corners of an insulated assembly.

A further advantage that is realized from this concept is that there is no displacement of the sealant material at the substrate engaging surfaces as would be encountered in a situation where transverse buckling did occur. In such situations, typically, the buckled portions force or squeeze the sealant material away from the highest point of the buckled material to therefore displace the sealant, at the flex point to a non-uniform thickness. This has energy consequences and reduces the seal efficiency of the system.

A further object of the present invention is to provide a composite cellular spacer for spacing substrates, comprising:

a flexible cellular body having a transverse dimension, the body including a front face and a rear face in spaced relation, a first substrate engaging surface and a second substrate engaging surface in spaced relation with the first substrate engaging surface;

a portion of material removed proximate each substrate engaging surface for substantially reducing and increase in the transverse dimension of the body when flexed;

the substrate engaging surfaces including a first sealant material for providing a first sealing surface; and a second sealant material different from the first sealant material associated with each substrate engaging surface to provide a second sealing surface.

As will be appreciated by those skilled in the art, the assembly may employ polyisobutylene (PIB), butyl, hot melt, or any other suitable sealant or butylated material. Sealing or other adhesion for the insulating body may be achieved by providing special adhesives, e.g., acrylic adhesives, pressure sensitive adhesives, hot melt inter alia.

By providing at least two different sealing materials, the result is that discrete and separate sealing surfaces are attributed to the spacer. This is useful in the event that one seal is compromised. The sealant materials may be embedded within one another.

A still further object of the present invention is to provide an insulated assembly, comprising:

a pair of substrates;

a composite cellular body having a front face and a rear face and a pair of substrate engaging surfaces;

a portion of material removed proximate the substrate engaging surfaces for substantially reducing an increase in a transverse dimension of the composite cellular body when the body is flexed about the corners of the insulated assembly;

a substrate engaged with a respective substrate engaging surface;

vapour barrier means associated with the rear face directed toward an interior atmosphere of the assembly;

a desiccated matrix associated with the vapour barrier means; and sealant means associated with each substrate engaging surface for sealing a respective substrate to a respective substrate engaging surface of the body.

The desiccated matrix may be configured to conform to any shape as required by the spacer body. Numerous advantages flow from the addition of the desiccated matrix, namely:

i) the addition of structural integrity to the spacer;

ii) the difference in density of the desiccated matrix relative to the cellular body further reduces the transmission of energy through the spacer from one side to the other; and iii) the hygroscopic properties of the desiccant material assists in maintaining an arid atmosphere between the substrates. Suitable desiccant materials are well known in the art and may include, as an example, zeolite beads, silica gel, calcium chloride, potassium chloride, inter alia, all of which may be matrixed within a semi-permeable flexible material such as a polysilicone or other suitable semi-permeable substance.

Yet another object of the present invention is to provide a composite cellular spacer for spacing substrates, comprising:

a flexible cellular body having a transverse dimension, the body including a front face and a rear face in spaced relation, a first substrate engaging surface and a second substrate engaging surface in spaced relation with the first substrate engaging surface;

a portion of material removed proximate each the substrate engaging surface for substantially reducing an increase in the transverse dimension of the body when flexed;

the substrate engaging surfaces including a first sealant material for providing a first sealing surface;

a second curable sealant material different from the first sealant material associated with each substrate engaging surface to provide a second sealing surface;

vapour barrier means contacting the rear face, the first sealant and the second sealant;

a third sealant different from the first sealant and the second sealant in contact with the vapour barrier means; and a desiccated matrix in adhesive contact with the third sealant and the vapour barrier means.

Regarding the vapour barrier, same may be metallized film, well known to those skilled in the art. Other suitable examples will be readily apparent.

Having thus generally described the invention, reference will now be made to the accompanying drawings illustrating preferred embodiments.

BRIEF DESCRIPTION OF THE DRAWINGS

Similar numerals in the drawing denote similar elements.

DETAILED DESCRIPTION OF THE PREFERRED EMBODIMENTS

Figure 1:
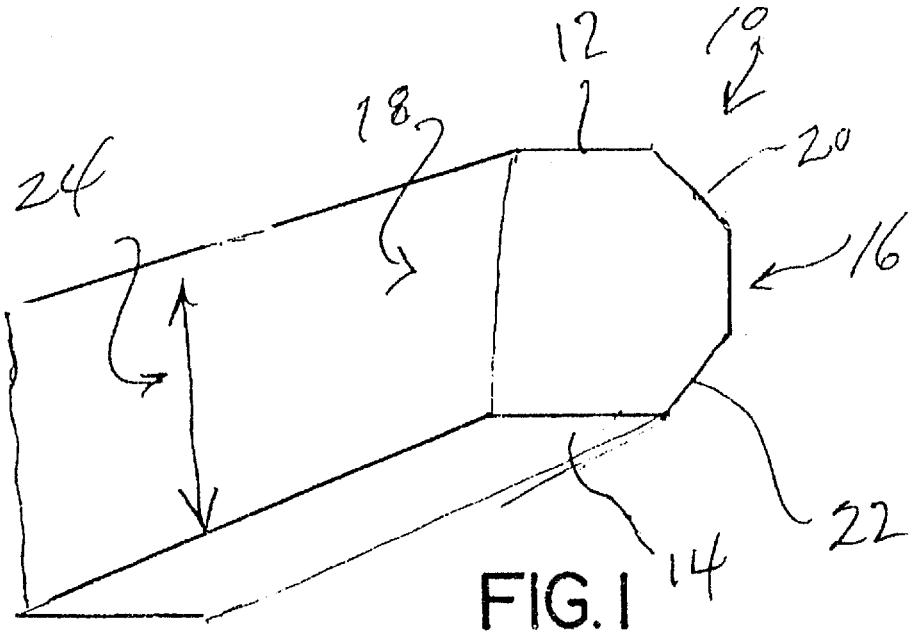
FIG. 1 is a perspective view of one embodiment of the present invention.

Referring now to FIG. 1, shown is one embodiment of the present invention in which numeral 10, globally denotes the spacer. In the embodiment shown, the spacer 10 includes a pair of substrate engaging surfaces 12 and 14 in spaced relation and each adapted to receive a substrate (not shown). The spacer body 10 includes a front face, globally denoted by numeral 16, and a rear face, globally denoted by numeral 18. As is illustrated in the example, the substrate engaging surfaces 12 and 14 each include a portion of material removed therefrom, the respective areas being denoted by numerals 20 and 22, respectively. In the example, the removed portions simply comprise cut corners 20 and 22, however, it will be understood by those skilled in the art that a significant number of variations are possible on this concept and this will be delineated hereinafter.

Figure 6:
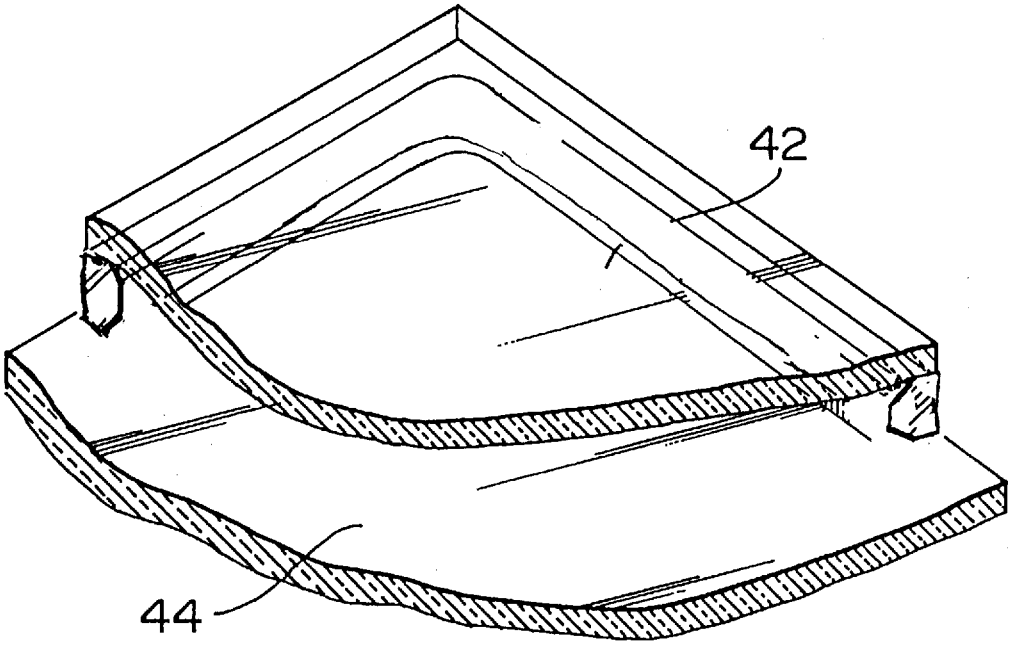
FIG. 6 is a perspective view of the spacer in-situ between substrates.
Figure 1:
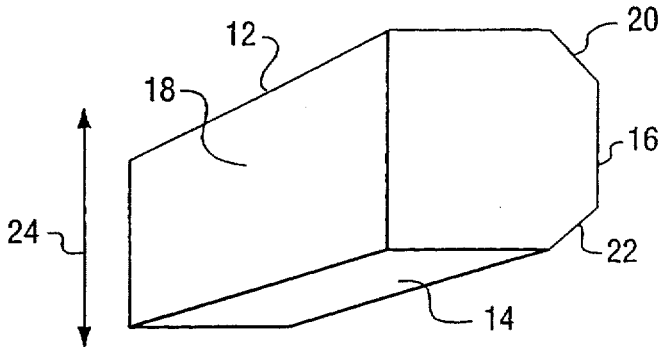
Figure 2:
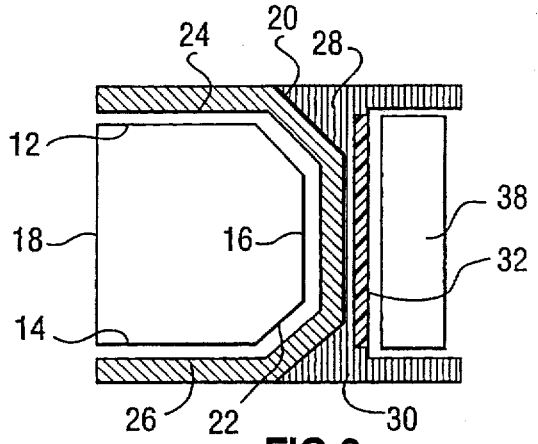
Figure 3:
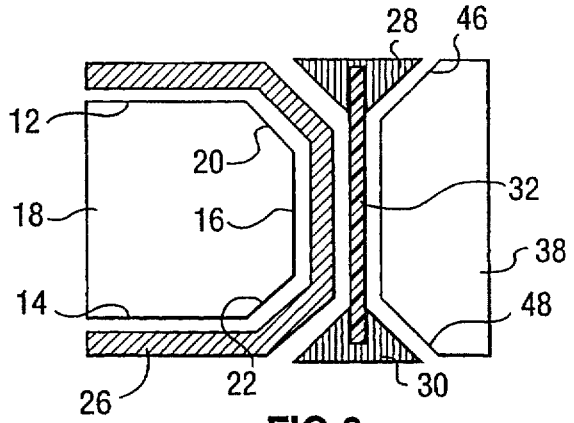
Figure 4A:
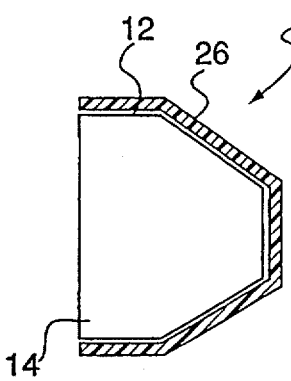
Figure 4B:
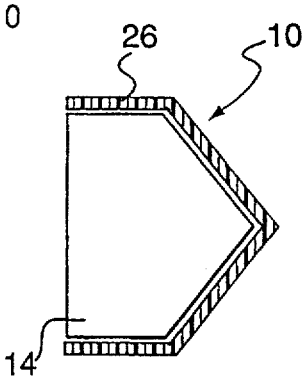
Figure 4C:
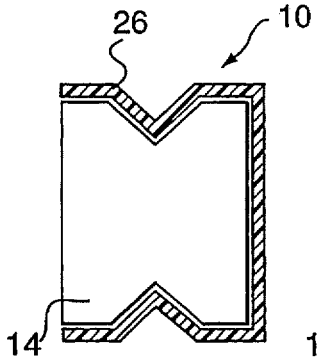
Figure 4D:
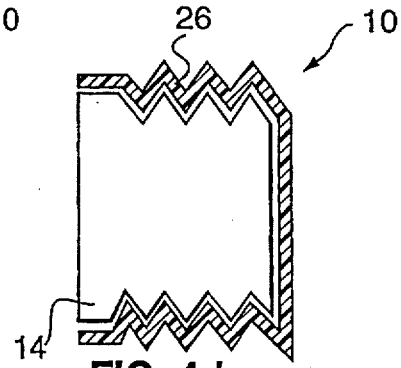
Figure 4E:
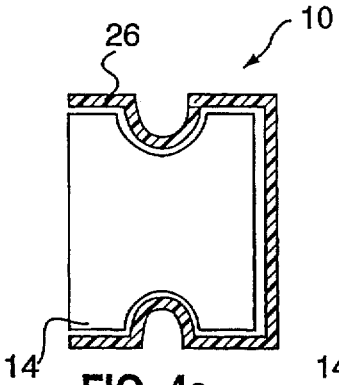
Figure 4F:
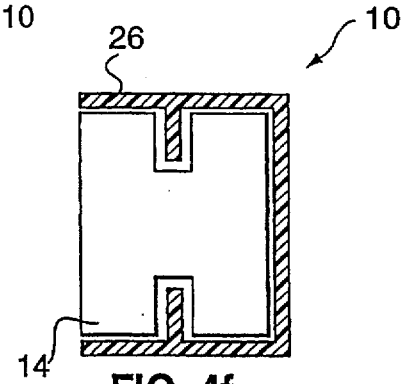
Figure 5:
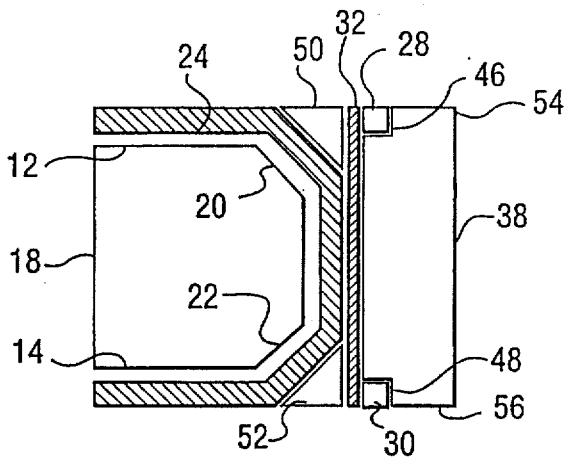
Figure 6:
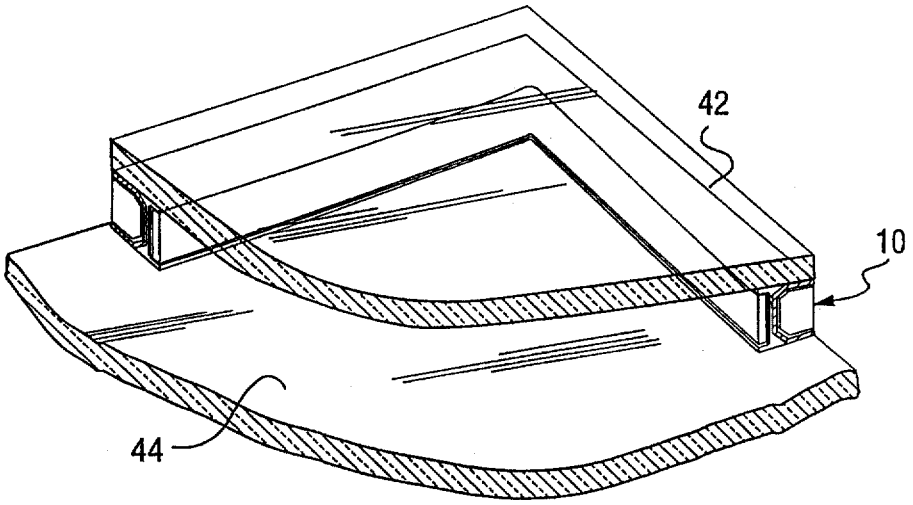

It has been found that by removing a portion of material from the substrate engaging surfaces 12 and 14, that the transverse dimension, indicated by the arrow 24 in FIG. 1, does not increase substantially when the spacer 10 is flexed. Flexure would typically occur at a corner when the spacer 10 is employed, as an example, between a pair of spaced apart substrates 42 and 44 as shown in FIG. 6. By removing a portion of material from each of the substrate engaging surfaces 12 and 14, no "buckling" results when the spacer is flexed at the corner and therefore the seal between the substrates 42 and 44 and respective surfaces 12 and 14 is not disrupted or rendered non-uniform as would be the case with the prior art.

Advantageously, the strip having the removed portions addresses and solves a problem persistent in the insulated glass industry, in particular-seal integrity and quality at the corners of the insulated assembly. By cutting the corners, for example, more sealant material can be included in the strip assembly and this is particularly true at the corners of the insulated assembly by the spacer according to the present invention. The result is a more dependable spacer not susceptible to ingress of moisture of other such limitations experienced by prior art arrangements.

In the example, the cut corners 20 and 22 of spacer body 10 may be in an angular relationship relative to the straight front face 16 of the respective substrate engaging surface from about 1° to about 60°. This will vary depending upon the specific intended use of the spacer and materials of which the spacer is made.

Regarding the spacer body 10, the same will preferably be composed of a cellular material which may be synthetic or naturally occurring. In the instance where the cellular material is composed of a naturally occurring material, cork and sponge may be suitable examples and in the synthetic version, suitable polymers including, but not limited to polyvinyl chlorides, polysilicone, polyurethane, polystyrene among others are suitable examples. Cellular material is desirable since such materials, while providing structural integrity additionally provide a high degree of interstices or voids between the material. In this manner, a high volume of air is included in the structure and when this is combined with an overall insulating material, the air voids complement the effectiveness of the insulation.

When the choice of material is not cellular, any number of the high insulating materials known to have utility for the subject matter herein may be selected.

Figure 2:
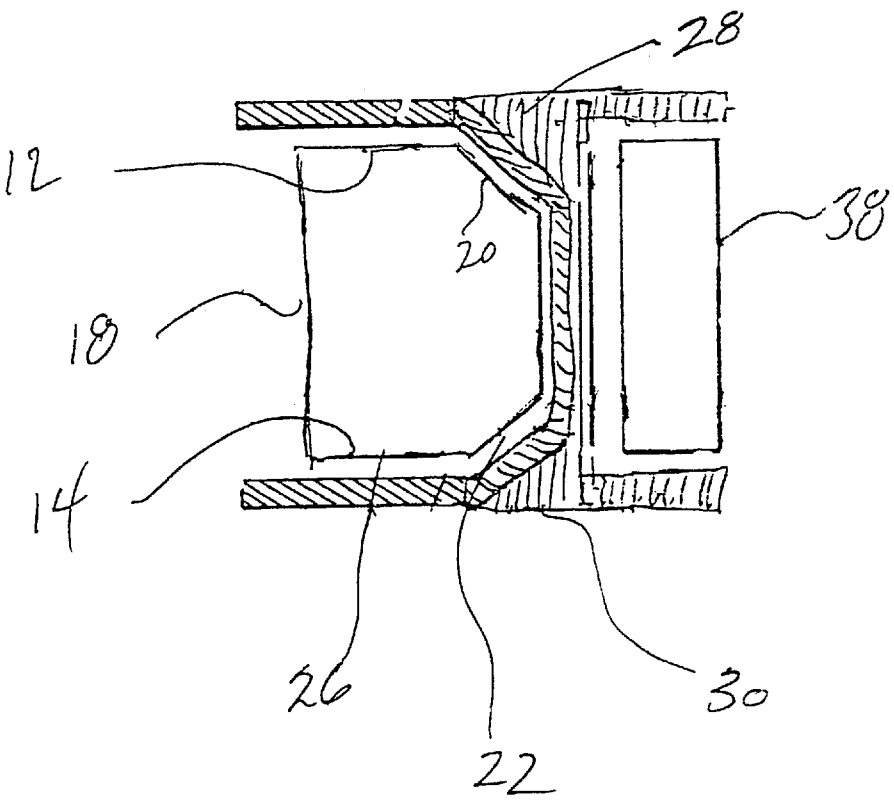
FIG. 2 is an exploded side view of FIG. 1 illustrating the ancillary elements.

Referring now to FIG. 2, shown is an embodiment of the spacer 10 which would be typically employed in an insulated glass assembly such as that shown in FIG. 6 wherein spacer 10 is exposed between two substrates 42 and 44 (FIG. 6) as discussed hereinbefore. With greater detail concerning FIG. 2, the substrate engaging surfaces 12 and 14 and front face 16 are each in contact with a first sealant material 26 which may comprise, as an example, hot melt. The sealant 26 generally subscribes to a C-shape. Adjacent to the first sealant 26, there is included a second sealant differing from the hot melt. The second sealant is arranged to fill the recesses formed as a result of the angled portions 20 and 22 on the body 10 while remaining in communication with the hot melt sealant 26. The second sealant, generally denoted by numerals 28 and 30, preferably comprises polyisobutylene (PIB). Other suitable materials or sealant and/or adhesion properties include acrylic adhesives, pressure sensitive adhesives, hot melt, polyisobutylene or other suitable butyl materials known to have utility for bonding such surfaces together.

As an additional feature in the embodiment shown in FIG. 2, the same includes a vapour barrier 32 which may comprise any of the suitable materials for this purpose, examples of which include polyester films, polyvinylfluoride films, etc. In addition, the vapour barrier 32 may be metallized. A useful example to this end is metallized Mylar™ film. In order to further enhance the effectiveness of the arrangement, vapour barrier 32 may be embedded in the polyisobutylene represented by numerals 28 and 30. This provision locates the barrier 32 and augments the structural integrity of the spacer 10.

An important feature related to the disposition of the vapour barrier 32, sealant 26 and soft spacer body 10, is the degree of compliance this arrangement affords the entire assembly and vapour barrier 32. The barrier 32, since it is adjacent a resilient and compliant body 10, does not experience undue mechanical stress which could result in delamination of some of the elements of the overall assembly. The advantage of this arrangement is that compliance is possible without substrate seal compromise.

A supplemental advantage to the compliant body 10 is realized in that the sealant 26 is in direct adhesive contact with body 10. This has particular value in facilitating resiliency and compliance of the sealant 26 thus preventing disruption or breach encountered in systems devoid of this feature.

Engaged with vapour barrier 32 by fusion, adhesion or other means of contact, there is further included a desiccated matrix 38. The desiccated matrix 38 is positioned in a juxtaposed manner to vapour barrier 32. Desiccated matrices are well known in the art and suitable desiccant materials include zeolite beads, calcium chloride, potassium chloride, silica gel among others matrixed within a semi-permeable material such as polysilicones etc. Matrix 38 is maintained in position by sealant 28 and 36 associated with vapour barrier 32.

The desiccated matrix 38 is directed towards the interior atmosphere of the assembly and to this end, rear face 18 of strip 10 may include additional peripheral sealing material. The selection of peripheral sealant will, of course, depend on the intended use and environment in which the assembly is to be used. A strong mechanical bond can be achieved using a host of suitable materials, examples of which include silicones, polysulfonated materials, butylated compound mixtures thereof, etc.

Figure 3:
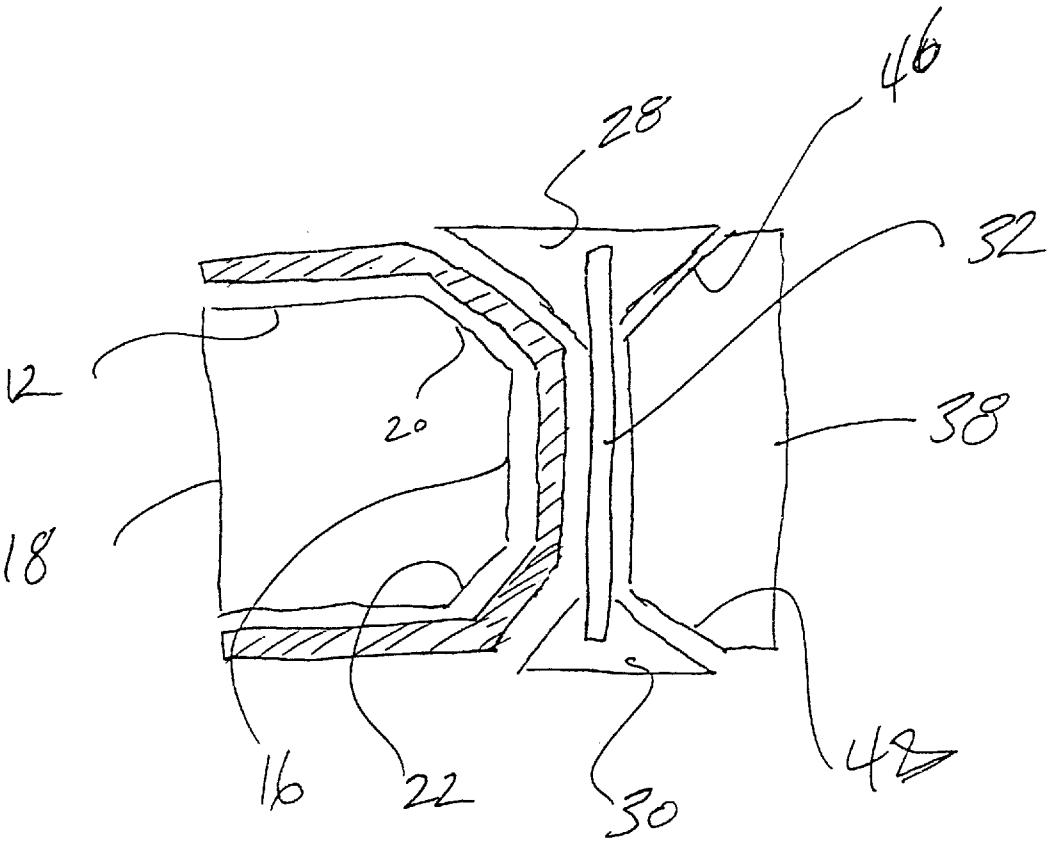
FIG. 3 is an exploded side view illustrating an alternate embodiment.

FIG. 3 illustrates an alternate embodiment of the assembly shown in FIG. 2. In the embodiment illustrated, the desiccated matrix 38 has cut inside corners 46 and 48 adjacent the contact surfaces for the substrate (not shown). In this manner, the recesses formed by the removed corners provide two areas within which the PIB may be disposed as shown. The removed areas have utility in containing the PIB from any "creeping" towards the interior atmosphere of the assembly when the spacer is positioned as shown in FIG. 6. Further, the recesses cooperate with those on body 10 to firmly position the vapour barrier 32. Any number of shape possibilities exist for the removed portions on matrix 38. As an example, the portions may be more arcuate.

Figures 4A, 4B, 4C, 4D, 4E, 4F:
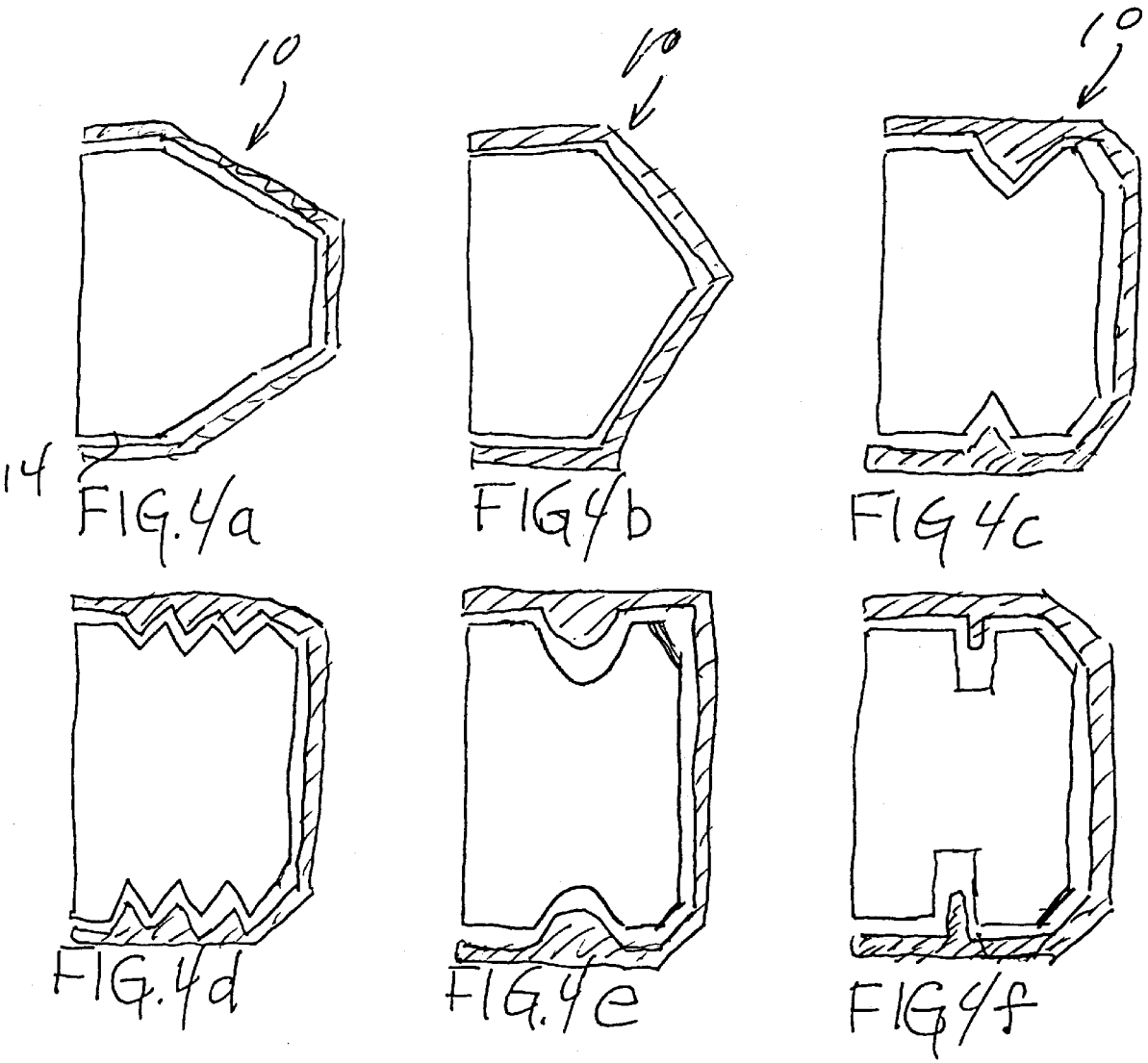
FIG. 4*a* to 4*f* are side views of alternate embodiments of the spacer of FIG. 1.

Referring now to FIGS. 4*a* through 4*f*, shown are further embodiments of the spacer as illustrated in FIG. 1. In particular, FIG. 4*a* illustrates a more pronounced cut corner version as illustrated in FIG. 1, FIG. 4*b* illustrates a version where the cut corners converge to a point to form an angular front face 16, FIG. 4*c* provides an arrowhead indentation in each of the substrates engaging surfaces 12 and 14. FIG. 4*d* provides a saw tooth arrangement in each of the surfaces 12 and 14 to reduce transverse expansion during bending. FIG. 4*e* provides a version where the surfaces 12 and 14 include semi-spherical, spherical recesses, while FIG. 4*f* provides a generally H-shaped profile.

In the instance where the material of which the spacer body is composed is formed of a material capable of elongation, then the difficulty with buckling about the corners of an insulated assembly may be obviated by simply elongating or "stretching" the body 10 prior to turning the corner in an insulated assembly as illustrated in FIG. 4. In this instance, the thickness of the spacer body will be reduced due to the elongation and therefore, when the same is turned about a corner, the buckling problem will not result. This prestressing procedure is applicable where material is capable of elongation and would, of course, exclude cork and other cellular materials not amenable to prestressing.

It will be understood that the cellular material selections may vary and that the first and/or second insulating materials may comprise mixtures of cellular materials to further enhance the insulating capacity of the assembly.

Figure 5:
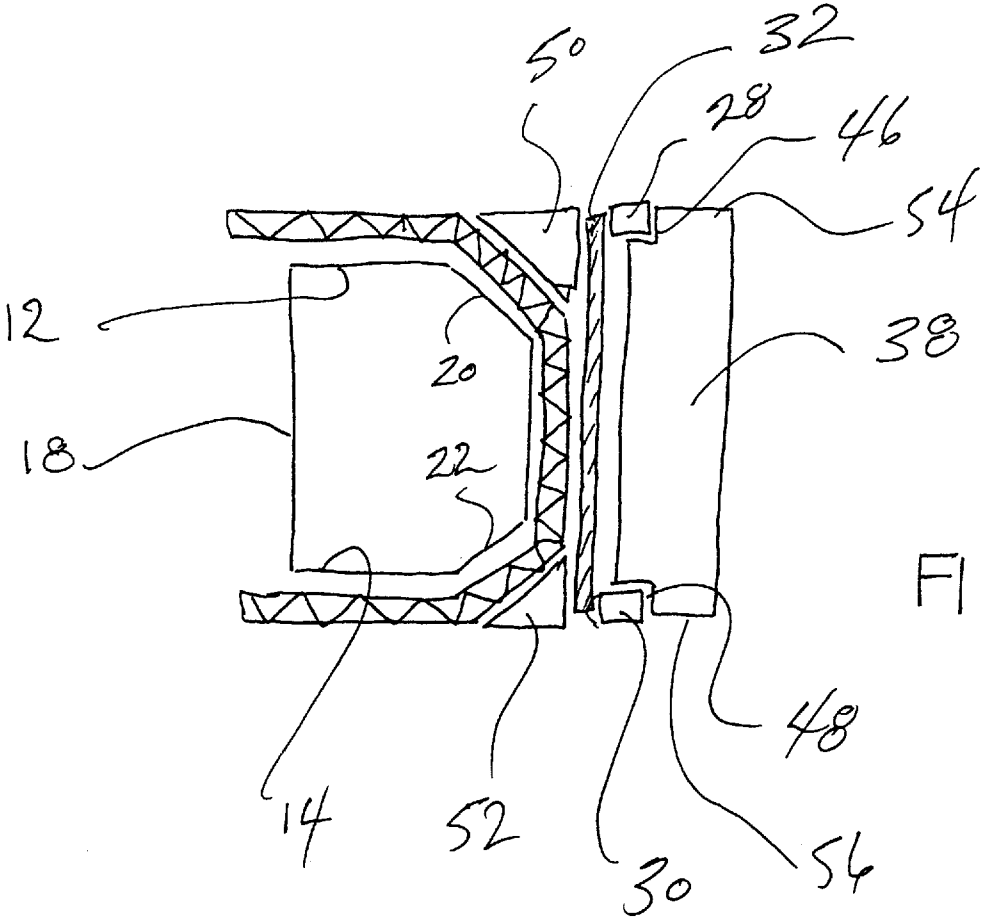
FIG. 5 is an exploded side view illustrating an alternate embodiment.

FIG. 5 illustrates yet another embodiment of the present invention in which at least three different sealant materials are incorporated in the spacer. In combination with the PIB 28 and 30, partially embedding vapour barrier 32 and sealant 26, there may be provided a third sealant/adhesive material 50 and 52 adjacent moisture barrier 32 and filling the corner areas of the body 10 as illustrated. In this embodiment, the material will probably be selected from any suitable uncured sealant/adhesive material known to those skilled. Useful examples, without being limiting include various silicones and urethanes. Such curable materials which may be curable by U.V.,I.R or other forms of electromagnetic energy provide utility in insulated assemblies since they, when cured, are capable of fusion with glass substrates (not shown in FIG. 5, see FIG. 6) and the moisture barrier 32. When exposed to curing conditions, the arrangement set forth above results in fusion at two distinct sites, namely, the interface of the sealant 50, 52 with each substrate (not shown) and with the moisture vapour barrier 32. This feature is quite beneficial to the overall mechanical integrity and consolidation of the spacer in the assembly. A further attendant advantage to this arrangement relates to the multiple distinct sealing surface it provides with the concomitant insulation against moisture ingress or energy transfer.

Optionally, substrate engaging surfaces 54 and 56 of desiccated matrix 30 may include curable adhesive materials as opposed to regular sealants/adhesives.

Further, it is contemplated that several different materials may be incorporated in the cellular material of the spacer body as set forth herein. In addition, it is to be understood that where the body is composed of several different materials, the materials need not be homogenously formed into a cellular body, e.g. by foaming etc., the same may be composed of a multiple section core body composed of several different materials sandwiched together.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. An insulated assembly having an interior atmosphere, comprising:

a pair of substrates;

a composite cellular body having a front face and a rear face and a pair of opposed substrate engaging surfaces, each substrate engaged with one of said pair of opposed substrate engaging surfaces, to define said interior atmosphere, said front face facing towards said interior atmosphere;

a portion of said composite cellular body removed proximate said substrate engaging surfaces at said front face for substantially reducing an increase in a transverse dimension of said composite cellular body when said body is flexed about corners of the insulated assembly;

vapour barrier means associated with said front face directed toward said interior atmosphere of said assembly;

a desiccated matrix associated with said vapour barrier means; and sealant means associated with each substrate engaging surface for sealing each substrate to one of said pair of substrate engaging surfaces of said composite cellular body.

2. The insulated assembly as set forth in claim 1, wherein said sealant means comprises at least two different sealant materials positioned to define at least two distinct sealing surfaces.

3. The insulated assembly as set forth in claim 2, wherein said at least two sealant materials comprise hot melt and polyisobutylene.

4. The insulated assembly as set forth in claim 3, wherein said polyisobutylene is at least partially imbedded in said hot melt.

5. The insulated assembly as set forth in claim 1, wherein said portion of material removed comprises at least corners of said rear face.

6. The insulated assembly as set forth in claim 1, wherein said sealant means directly adhesively contacts said substrate engaging surfaces and said front face.

7. An insulated substrate assembly having an interior atmosphere and corners, comprising:

a pair of substrates;

a spacer spacing said substrates in spaced relation, said spacer comprising a flexible cellular body having a front face facing towards said interior atmosphere and a rear face in spaced relation, a first substrate engaging surface and a second substrate engaging surface in transverse spaced relation with said first substrate engaging surface, each substrate engaging surface having a substrate engaged therewith, said front face having a portion of said cellular body removed adjacent each corner formed between said front face and one of said substrate engaging surfaces for substantially reducing a transverse increase in dimension of said body when said body is flexed about said corners of said assembly.

8. The assembly as set forth in claim 7, wherein said front face of said spacer includes vapour barrier means.

9. The assembly as set forth in claim 8, wherein said spacer further includes a desiccated matrix.

10. The assembly as set forth in claim 9, wherein said desiccated matrix is positioned adjacent said vapour barrier means.

11. The assembly as set forth in claim 8, wherein said spacer includes a first sealant contacting said substrate engaging surfaces and said front face, said first sealant generally conforming to a C-shape.

12. The assembly as set forth in claim 11, wherein said spacer includes a second sealant positioned in contact with said first sealant at each said corner.

13. The assembly as set forth in claim 12, further including a vapour barrier means at least partially embedded in said second sealant.

14. The assembly as set forth in claim 7, wherein said first sealant comprises hot melt.

15. The assembly as set forth in claim 12, wherein said second sealant comprises polyisobutylene.

16. The assembly as set forth in claim 7, wherein said cellular body comprises EPDM.

17. The assembly as set forth in claim 7, wherein said cellular body comprises foam material.

18. The assembly as set forth in claim 7, wherein said foam material includes at least two chemical materials.

19. An insulated substrate assembly having an interior atmosphere and corners, comprising:

a pair of substrates;

a composite spacer spacing said substrates in spaced relation, said composite spacer comprising:

(a) a flexible cellular body having a transverse dimension defined by lateral surfaces each disposed in opposing relationship to one of said substrates, said cellular body also having a front face facing said interior atmosphere of said assembly, said cellular body having portions removed proximate each of said lateral surfaces at said front face to define angular surfaces disposed between said front face and each one of said lateral surfaces, whereby any transverse dimension increase of said composite spacer, when flexed at said corners, is reduced, and (b) a substantially C-shaped body of first sealant material in contact with said front face and said angular and lateral surfaces of said cellular body, said first sealant material having a front face directed towards said interior atmosphere of said assembly and lateral portions disposed between one of said substrates and one of said lateral surfaces of said cellular body.

20. The insulated assembly as set forth in claim 19, wherein said portions removed from said cellular body comprise cut corners, said cut corners being in an angular relationship relative to said front face from about 1° to about 60°.

21. The assembly as set forth in claim 19, wherein said front face of said first sealant material includes vapour barrier means.

22. The assembly as set forth in claim 19, wherein said spacer further includes a dessicated matrix adjacent said front face of said first sealant material.

23. The assembly as set forth in claim 21, wherein a dessicated matrix is positioned adjacent said vapour barrier means.

24. The assembly as set forth in claim 19, wherein said spacer includes a second sealant positioned in contact with said first sealant at each of said angular surfaces.

25. The assembly as set forth in claim 24, wherein said spacer further includes a vapour barrier means at least partially embedded in said second sealant.

26. The assembly as set forth in claim 19, wherein said first sealant comprises hot melt.

27. The assembly as set forth in claim 24, wherein said second sealant comprises polyisobutylene.

28. The assembly as set forth in claim 19, wherein said cellular body comprises EPDM.

29. The assembly as set forth in claim 19, wherein said cellular body comprises foam material.

30. The assembly as set forth in claim 29, wherein said foam material includes at least two chemical materials.

* * * * *

UNITED STATES PATENT AND TRADEMARK OFFICE

CERTIFICATE OF CORRECTION

PATENT NO. : 5,806,272
DATED : September 15, 1998
INVENTOR(S) : Luc Lafond

It is certified that error appears in the above-identified patent and that said Letters Patent is hereby corrected as shown below:

The title page, should be deleted to appear as per attached title page.
The sheets of drawings consisting of figures 1-6, should be deleted to appear as per attached figures 1-6.

Signed and Sealed this

Twenty-eighth Day of September, 1999

*Attest:*

Q. TODD DICKINSON

*Attesting Officer*

*Acting Commissioner of Patents and Trademarks*

US005806272A

United States Patent [19]

Lafond

[11] Patent Number: 5,806,272

[45] Date of Patent: Sep. 15, 1998

[54] FOAM CORE SPACER ASSEMBLY

[76] Inventor: Luc Lafond, 23 Woodvalley Drive, Etobicoke, Ontario, Canada, M9A 4H4

[21] Appl. No.: 656,684

[22] Filed: May 31, 1996

[51] Int. Cl.[6] ..... E04C 2/54

[52] U.S. Cl. ..... 52/786.13; 52/172; 52/786.11; 156/109; 428/34; 428/192

[58] Field of Search ..... 52/172, 786.11, 52/786.13; 156/105, 107, 109; 428/34, 192

[56] References Cited

U.S. PATENT DOCUMENTS

| | | | |
|---|---|---|---|
| 3,427,776 | 2/1969 | Lake et al. . | |
| 4,120,999 | 10/1978 | Chenel et al. . | |
| 4,149,348 | 4/1979 | Pyzewski | 52/783.13 X |
| 4,205,104 | 5/1980 | Chenel . | |
| 4,622,249 | 11/1986 | Bowser . | |
| 4,649,685 | 3/1987 | Wolf et al. . | |
| 4,822,649 | 4/1989 | Canaud et al. . | |
| 4,831,799 | 5/1989 | Glover et al. . | |
| 4,950,344 | 8/1990 | Glover et al. . | |
| 5,209,034 | 5/1993 | Box et al. | 52/786.13 X |
| 5,260,112 | 11/1993 | Grether et al. . | |
| 5,270,091 | 12/1993 | Krysiak et al. . | |
| 5,308,662 | 5/1994 | Woodard et al. | 52/786.11 X |
| 5,391,411 | 2/1995 | Rowland et al. | 52/786.13 X |
| 5,436,040 | 7/1995 | Lafond | 428/34 |
| 5,441,779 | 8/1995 | Lafond | 428/34 |
| 5,447,761 | 9/1995 | Lafond | 428/34 |
| 5,461,840 | 10/1995 | Taylor | 52/786.13 |
| 5,466,534 | 11/1995 | Newby | 428/34 X |
| 5,503,884 | 4/1996 | Meyer | 52/172 X |

*Primary Examiner*—Beth Aubrey
*Attorney, Agent, or Firm*—Ian Fincham

[57] ABSTRACT

There is disclosed a soft and compliant spacer body wherein the body is provided with modified substrate engaging surfaces to accommodate transverse dimensional changes when the spacer is bent about a corner or otherwise flexed in an insulated assembly. In one embodiment, the corners are cut to reduce the thickness of the strip as the same is bent or flexed about a corner. Other embodiments are disclosed. The advantage is that when the transverse dimension is maintained relatively constant about the bent corner, the result is a more effective seal between the substrate engaging surfaces and the substrates. This is augmented by the use of cellular materials and selected sealants to provide multiple sealing surfaces in a high efficiency spacer body.

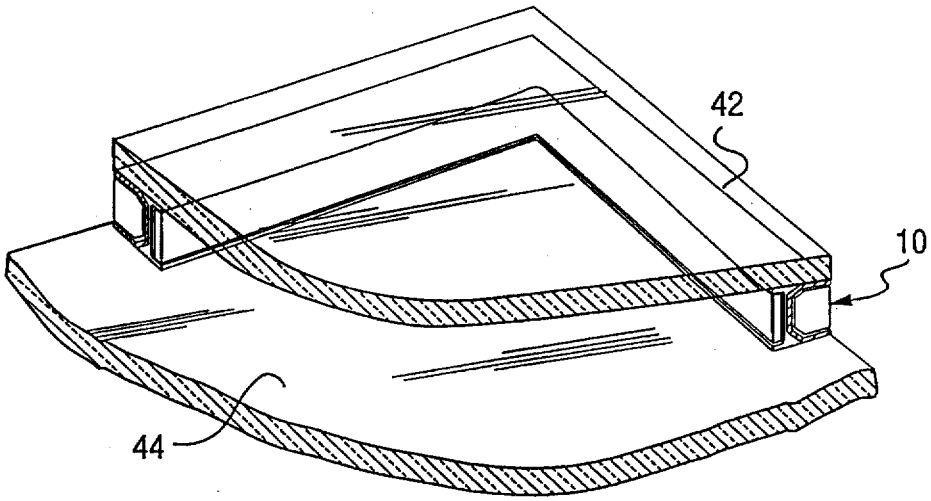

30 Claims, 3 Drawing Sheets